US006440916B1

(12) United States Patent
Cheung et al.

(10) Patent No.: US 6,440,916 B1
(45) Date of Patent: Aug. 27, 2002

(54) HARD SURFACE CLEANING AND DISINFECTING COMPOSITIONS COMPRISING FLUOROSURFACTANTS

(75) Inventors: Tak Wai Cheung, Bridgewater; Dennis Thomas Smialowicz, Waldwick; Minaxi Hemansu Mehta, Fairlawn, all of NJ (US)

(73) Assignee: Reckitt & Colman Inc., Wayne, NJ (US)

( * ) Notice: Subject to any disclaimer, the term of this patent is extended or adjusted under 35 U.S.C. 154(b) by 0 days.

(21) Appl. No.: 09/938,118

(22) Filed: Aug. 23, 2001

Related U.S. Application Data

(62) Division of application No. 09/620,186, filed on Jul. 20, 2000, now Pat. No. 6,306,810, which is a division of application No. 09/368,004, filed on Aug. 3, 1999, now Pat. No. 6,136,770.

(30) Foreign Application Priority Data

Aug. 12, 1998 (GB) ..... 9817457

(51) Int. Cl.[7] ..... C11D 1/00

(52) U.S. Cl. ..... 510/238; 510/191; 510/423; 510/427; 510/433; 510/384; 510/391; 510/466; 510/504; 510/505

(58) Field of Search ..... 510/191, 238, 510/423, 427, 433, 504, 505, 384, 391, 466; 134/42

(56) References Cited

U.S. PATENT DOCUMENTS

| | | | | |
|---|---|---|---|---|
| 3,681,441 A | | 8/1972 | Robertson | 260/501.15 |
| 4,020,016 A | | 4/1977 | Sokol | 252/546 |
| 4,304,563 A | | 12/1981 | Grollier et al. | 8/127.51 |
| 4,416,787 A | | 11/1983 | Marshall et al. | 252/8.8 |
| 4,443,364 A | | 4/1984 | Klinger et al. | 252/547 |
| 4,584,196 A | | 4/1986 | Vanlerberghe et al. | 424/70 |
| 4,764,975 A | | 8/1988 | Iovanni et al. | 424/70 |
| 5,110,868 A | | 5/1992 | Bellis et al. | 252/174.23 |
| 5,120,532 A | | 6/1992 | Wells et al. | 424/70 |
| 5,397,398 A | * | 3/1995 | Van Vlahakis et al. | 134/22.11 |
| 5,415,811 A | | 5/1995 | Wile et al. | 252/546 |
| 5,429,764 A | * | 7/1995 | Van Vlahakis et al. | 252/146 |
| 5,441,585 A | | 8/1995 | Rodda et al. | 156/256 |
| 5,514,301 A | | 5/1996 | Bil et al. | 252/545 |
| 5,716,765 A | | 2/1998 | McGuckin et al. | 430/372 |
| 5,849,681 A | * | 12/1998 | Neumiller et al. | 510/182 |
| 5,958,144 A | | 9/1999 | Cala et al. | 134/2 |
| 6,010,539 A | | 1/2000 | Del Pesco | 8/137 |
| 6,136,770 A | | 10/2000 | Cheung et al. | 510/384 |

FOREIGN PATENT DOCUMENTS

| | | | |
|---|---|---|---|
| EP | 0 002 004 | 5/1979 | C07C/149/24 |
| EP | 0 415 540 A1 | 3/1991 | C11D/3/00 |
| GB | 1 487 811 | 10/1977 | A61L/13/00 |
| WO | WO97/36980 | 10/1997 | C11D/3/16 |

OTHER PUBLICATIONS

Copy of GB Search Report for GB Application No. 9918890.6 dated Dec. 6, 1999.

Copy of GB Search Report for GB Application No. 9918549.8 dated Dec. 7, 1999.

Derwent Publication, Class A97, AN 1996–515316, XP002122166 & JP 08 269495 A (Sanyo Chem Ind Ltd), Oct. 15, 1996 abstract.

Derwent Publication, Class D25, AN 1993–297503, XP002122167 & JP 05 208102 A (Asahi Glass Co Ltd), Aug. 20, 1993 abstract.

Copy of PCT Search Report dated Nov. 22, 1999 for PCT/GB99/02571.

Derwent Publications AN 1995–281200, XP002119645 & JP 07 179892 A, Jul. 18, 1995, abstract.

Copy of PCT International Search Report for PCT/GB99/02572 dated Nov. 2, 1999.

* cited by examiner

*Primary Examiner*—Gregory Delcotto
(74) *Attorney, Agent, or Firm*—Fish & Richardson P.C.

(57) ABSTRACT

The present invention provides a process for cleaning or sanitization of hard surfaces, which process comprises the step of providing a composition containing a cationic surfactant, a fluorosurfactant, a film forming, organosilicone quaternary ammonium compound, along with optional components, and applying such a composition to a hard surface in need of cleaning.

5 Claims, No Drawings

HARD SURFACE CLEANING AND DISINFECTING COMPOSITIONS COMPRISING FLUOROSURFACTANTS

This application is a divisional application of U.S. Ser. No. 09/620,186 filed Jul. 20, 2000, now U.S. Pat. No. 6,306,810, which in turn is a divisional application of U.S. Ser. No. 09/368,004 filed Aug. 3, 1999, now U.S. Pat. No. 6,136,770.

The present invention generally relates to hard surface treatment compositions which impart a cleaning and sanitizing effect, as well as processes for their use.

Cleaning compositions are commercially important products and enjoy a wide field of utility in assisting in the removal of dirt and grime from surfaces, especially those characterized as useful with "hard surfaces". Hard surfaces are those which are frequently encountered in lavatories such as lavatory fixtures such as toilets, shower stalls, bathtubs, bidets, sinks, etc., as well as in kitchen and food preparation facilities, such as countertops, cabinet and appliance surfaces, as well as walls, floors, etc.

The prior art has suggested many aqueous compositions which are directed to provide a cleaning or disinfecting benefit to such hard surfaces. Certain of these provide both effective cleaning and disinfection of a treated surfaces. These compositions predominantly are aqueous preparations which include one or more detersive surfactants, one or more organic solvents and in minor amounts, conventional additives included enhance the attractiveness of the product, typically fragrances and coloring agents.

While these known-art compositions may provide advantages, there is a continuing need in the art for such hard surface treatment compositions which include reduced amounts of active constituents, and which minimize or eliminate the amounts of organic solvents which need be present in such compositions.

It is yet a further object of the invention to provide a readily pourable and readily pumpable cleaning composition which features the benefits described above.

It is a further object of the invention to provide a process for cleaning or sanitization of hard surfaces, which process comprises the step of: providing the composition as outlined above, and applying an effective amount to a hard surface requiring such treatment. The composition of the invention may also provide some residual sanitizing activity.

These and other objects of the invention shall be more apparent from a reading of the specification and of the claims attached.

According to a first aspect of the invention there is provided a hard surface cleaning and disinfecting composition which comprises (preferably, consisting essentially of) the following constituents:

(a) at least one cationic surfactant compound having germicidal properties;

(b) a fluorosurfactant selected from the group of nonionic fluorosurfactant, cationic fluorosurfactant, and mixtures thereof;

(c) a film-forming, organosilicone quaternary ammonium compound;

(d) optionally, one or more detersive surfactants particularly selected from carboxylate surfactants as well as nonionic, cationic and amphoteric surfactants;

(e) optionally, one or more organic solvents;

(f) a major proportion of water.

The compositions described above may include one or more further conventional optional constituents such as: pH buffering agents, perfumes, perfume carriers, colorants, hydrotropes, germicides, fungicides, anti-oxidants, anti-corrosion agents, and the like.

Preferred compositions according to the invention are largely aqueous, and are readily pourable and pumpable when packaged from a manually operable pump, such as a 'trigger spray' dispenser. The preferred compositions of the invention feature good cleaning, disinfection of hard surfaces and little or no buildup of residue on treated hard surfaces.

According to a second aspect of the invention, there is provided a hard surface cleaning and disinfecting composition which comprises (preferably, consisting essentially of) the following constituents:

(a) at least one cationic surfactant compound having germicidal properties;

(b) a fluorosurfactant selected from the group of nonionic fluorosurfactant, cationic fluorosurfactant, and mixtures thereof;

(c) a film-forming, organosilicone quatemary ammonium compound;

(d) one or more detersive surfactants particularly selected from carboxylate surfactants as well as nonionic, cationic and amphoteric surfactants;

(f) a major proportion of water; characterized wherein the compositions are essentially free of (e) one or more organic solvents, such as water soluble alcohols, ethers, and glycol ethers. These compositions may include one or more further conventional optional constituents such as: pH buffering agents, perfumes, perfume carriers, colorants, hydrotropes, germicides, fungicides, anti-oxidants, anti-corrosion agents, and the like.

According to a third aspect of the invention, there is provided a hard surface cleaning and disinfecting composition which comprises (preferably, consists essentially of) the following constituents:

(a) at least one cationic surfactant compound having germicidal properties;

(b) a fluorosurfactant selected from the group of nonionic fluorosurfactant, cationic fluorosurfactant, and mixtures thereof;

(c) a film forming, organosilicone quaternary ammonium compound;

(e) one or more organic solvents;

(f) a major portion of water;

wherein the compositions are essentially free of (d) one or more detersive surfactants particularly selected from carboxylate surfactants, as well as nonionic, cationic, and amphoteric surfactants. These compositions may include one or more further conventional optional constituents such as: pH buffering agents, perfumes, perfume carriers, colorants, hydrotropes, viscosity modifying agents, further germicides, fungicides, anti-oxidants, and anti-corrosion agents, and the like.

In accordance with a fourth aspect of the invention first aspect of the invention there is provided a hard surface cleaning and disinfecting composition which comprises (preferably, consisting essentially of) the following constituents:

(a) at least one cationic surfactant compound having germicidal properties;

(b) fluorosurfactant selected from the group of nonionic fluorosurfactant, cationic fluorosurfactant, and mixtures thereof;

(c) a film-forming, organosilicone quaternary ammonium compound;

(f) a major proportion of water;

wherein the compositions are essentially free of (d) detersive surfactants, particularly carboxylate surfactants as well as nonionic, cationic and amphoteric surfactants, as well as being essentially free of (e) organic solvents.

The compositions described above may include one or more further conventional optional constituents such as: pH buffering agents, perfumes, perfume carriers, colorants, hydrotropes, germicides, fungicides, anti-oxidants, anti-corrosion agents, and the like.

The aqueous compositions taught herein provide surprisingly good cleaning and disinfection of hard surfaces merely with the inclusion of the preferred germicidal constituents and the flurosurfactant, and at the same time provide a surface protective coating due to the inclusion of the film-forming, organosilicone quaternary ammonium compound. These excellent results are obtained without the inclusion of: further organic solvents (in accordance with the second aspect of the invention) or further detersive surfactants (in accordance with the third aspect of the invention), or either of these latter materials (in accordance with the fourth aspect of the invention) It is particularly surprising that excellent cleaning and disinfecting results are obtained in accordance with the fourth aspect of the invention, including embodiments which consist essentially of a major proportion of water, a fluorosurfactant constituent, the film-forming, organosilicone quatemary ammonium compound, and one or more quaternary ammonium compounds as the germicidal constituent.

The compositions described above may include one or more further conventional optional constituents such as: pH buffering agents, perfumes, perfume carriers, colorants, hydrotropes, germicides, fungicides, anti-oxidants, anti-corrosion agents, and the like.

The inventive compositions necessarily include (a) at least one cationic surfactant compound having germicidal properties.

Particularly preferred for use as the (a) at least one cationic surfactant compound having germicidal properties are those which provide a broad antibacterial or sanitizing function. Any cationic surfactant which satisfies these requirements may be used and are considered to be within the scope of the present invention, and mixtures of two or more cationic surface active agents, viz., cationic surfactants may also be used. Cationic surfactants are well known, and useful cationic surfactants may be one or more of those described for example in *McCutcheon's Detergents and Emulsifiers*, North American Edition, 1998; *Kirk-Othmer, Encyclopedia of Chemical Technology*, 4th Ed., Vol. 23, pp. 478–541, the contents of which are herein incorporated by reference.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

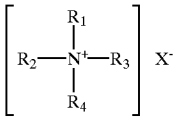

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quatemary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium inethosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

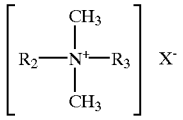

wherein $R_2$ and $R_3$ are the same or different $C_8$–$C_{12}$alkyl, or $R_2$ is $C_{12-16}$alkyl, $C_8$-alkylethoxy, $C_{8-18}$alkylphenoxyethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quatemary germicides include compositions which include a single quatemary compound, as well as mixtures of two or more different quaternary compounds. Such useful quaternary compounds are available under the BARDAC®, BARQUAT®, HYAMINE®, LONZABAC®, BTC®, and ONYXEDE® trademarks, which are more fully described in, for example, *McCutcheon's Functional Materials* (Vol. 2), North American Edition, 1998, and the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M); described generally in *McCutcheon's* as a combination of alkyl dim ethyl benzyl ammonium chloride and dialkyl dimethyl ammonium chloride); BARDAC® 205 M is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 425OZ (each 50% active) or BARQUAT® 4280 and BARQUAT® 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (available either as 100% actives or as a 50% actives solution); HYAMINE® 3500 (50% actives), described as alkyl dimethyl benzyl ammonium chloride (also available as 80% active (HYAMINE® 3500-80); and HYAMINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc.: Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% active); BTC® 776 is described to be myristalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.). Polymeric quaternary ammonium salts based on these monomeric structures are also considered desirable for the present invention. One example is POLYQUAT®, described as being a 2-butenyldimethyl ammonium chloride polymer.

The germicidal constituent may be present in any effective amount, but generally need not be present in amounts in excess of about 10% wt. based on the total weight of the composition. The preferred germicidal cationic surfactant(s) may be present in the concentrated liquid disinfectant compositions in amounts of from about 0.001% by weight to up to about 10% by weight, preferably about 0.01–8% by weight, most preferably in amount of between 0.5–6% by weight. It is particularly advantageous that the preferred germicidal cationic surfactant(s) are present in amounts of at least 200 parts per million (ppm), preferably in amounts of 200–700 ppm, more preferably in amounts of from 250–500 ppm.

The inventive compositions necessarily include (b) at least one fluorosurfactant selected from nonionic fluorosurfactants, cationic fluorosurfactants, and mixtures thereof which are soluble in the aqueous compositions being taught herein, particularly compositions which do not include further detersive surfactants, or further organic solvents, or both. Particularly useful nonionic fluorosurfactant compounds are found among the materials presently commercially marketed under the tradename Fluorad® (ex. 3M Corp.) Exemplary useful fluorosurfactants include those sold as Fluorad® FC-740, generally described to be fluorinated alkyl esters; Fluorad® FC-430, generally described to be fluorinated alkyl esters; Fluorad® FC-431, generally described to be fluorinated alkyl esters; and, Fluorad® FC-170-C, which is generally described as being fluorinated alkyl polyoxyethlene ethanols.

An especially useful nonionic fluorosurfactant compounds include those which is believed to conform to the following formulation:

$$C_nF2_{n+1}SO_2N(C_2H_5)(CH_2CH_2O)_xCH_3$$

wherein:

n has a value of from 1–12, preferably from 4–12, most preferably 8;

x has a value of from 4–18, preferably from 4–10, most preferably 7;

which is described to be a nonionic fluorinated alkyl alkoxylate and which is sold as Fluorad® FC-171 (ex. 3M Corp., formerly Minnesota Mining and Manufacturing Co.).

Additionally particularly useful nonionic fluorosurfactant compounds are also found among the materials marketed under the tradename ZONYL® (DuPont Performance Chemicals). These include, for example, ZONYL® FSO and ZONYL® FSN. These compounds have the following formula:

$$RfCH_2CH_2O(CH_2CH_2O)_xH$$

where Rf is $F(CF_2CF_2)_y$. For ZONYL® FSO, x is 0 to about 15 and y is 1 to about 7. For ZONYL® FSN, x is 0 to about 25 and y is 1 to about 9.

An example of a useful cationic fluorosurfactant compound has the following structure:

$$C_nF_{2n+1}SO_2NHC_3H_6N^+(CH_3)_3I^-$$

where n~8. This cationic fluorosurfactant is available under the tradename Fluorad® FC-135 from 3M.

Another example of a useful cationic fluorosurfactant is $$F_3—(CF_2)n—(CH_2)_mSCH_2CHOH—CH_2—N^+R_1R_2R_3Cl$$

wherein: n is 5–9 and m is 2, and $R_1$, $R_2$ and $R_3$ are $—CH_3$. This cationic fluorosurfactant is available under the tradename ZONYL® FSD (available from DuPont, described as 2-hydroxy-3-((gamma-omega-perfluoro-$C_{6-20}$-alkyl)thio)-N,N,N-trimethyl-1-propyl ammonium chloride).

Other cationic fluorosurfactants suitable for use in the present invention are also described in EP 866 115.

The fluorosurfactant selected from the group of nonionic fluorosurfactant, cationic fluorosurfactant, and mixtures thereof is present in amounts of from 0.001 to 5% wt., preferably from 0.01 to 5% wt., and more preferably from 0.01 to 2.5% wt.

The inventive compositions necessarily include (c) a film-forming, organosilicone quatemary ammonium compound.

The aqueous compositions according to the invention comprise a) a film-forming, organosilicone quatemary ammonium compound. Such compounds desirably also exhibit antimicrobial activity, especially on hard surfaces.

Specific examples of organosilicone quaternary ammonium salts that may be used in the compositions of this invention include organosilicone derivatives of the following ammonium salts: di-isobutylcresoxyethoxyethyl dimethyl benzyl ammonium chloride, di-isobutylphenoxyethoxyethyl dimethyl benzyl ammonium chloride, myristyl dimethylbenzyl ammonium chloride, myristyl picolinium chloride, N-ethyl morpholinium chloride, laurylisoquinolinium bromide, alkyl imidazolinium chloride, benzalkonium chloride, cetyl pyridinium chloride, coconut dimethyl benzyl ammonium chloride, stearyl dimethyl benzyl ammonium chloride, alkyl dimethyl benzyl ammonium chloride, alkyl diethyl benzyl ammonium chloride, alkyl dimethyl benzyl ammonium bromide, di-isobutyl plhenoxyethoxyethlyl trimethyl ammonium chloride, di-isobutylphenoxyethoxyethyl dimethyl alkyl ammonium chloride, methyl-dodecylbenzyl trimethyl ammonium chloride, cetyl trimethyl ammonium bromide, octadecyl dimethyl ethyl ammonium bromide, cetyl dimethyl ethyl ammonium bromide, octadec-9-enyl dimethyl ethyl ammonium bromide, dioctyl dimethyl amnonium chloride, dodecyl trimethyl ammonium chloride, octadecyl trimethyl ammonium chloride, octadecyl trimethyl ammonium bromide, hexadecyl trimethyl ammonium iodide, octyl trimethyl ammonium fluoride, and mixtures thereof. Other water dispersible salts, such as the acetates, sulfates, nitrates, and phosphates, are effective in place of the halides, but the chlorides and bromides are preferred. The silicone group is preferably substituted with alkyl ethers. Preferred alkyl ethers are short carbon chain ethers such as methoxy and ethoxy substituents.

Examples of particularly preferred film-forming, organosilicone quaternary ammonium compounds which find use in the present inventive compositions include those which may be represented by the following structural representation:

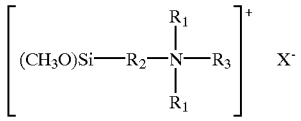

wherein:

$R_1$ and $R_2$ each independently represent short chain alkyl or alkenyl groups, preferably $C_1$–$C_8$ alkyl or alkenyl groups;

$R_3$ represents a $C_{11}$–$C_{22}$ alkyl group; and

X represents a salt forming counterion, especially a halogen.

Preferred short chain alkyl substituents for $R_1$ are methyl and ethyl, preferred short chain alkyl substituents for $R_2$ are straight chain links of methylene groups consisting of from 1 to 4 members, preferred $R_3$ substituents are straight chain links of methylene groups consisting of from 11 to 22 members, and preferred halogens for X are chloride and bromide.

A particularly preferred and commercially available film-forming, organosilicone quaternary ammonium compound useful in the inventive compositions is AEM® 5772 or AEM® 5700 (from Aegis Environment al Co., Midland, Mich.). Both of these materials are described as being 3-(trimethoxysilyl)propyloctadecyldimethyl ammonium chloride, AEM® 5700 and is sold as a 42% by weight active solution of the compound in a water/methanol mixture, while AEM® 5772 is sold as a 72% by weight active solution of the compound in a water/methanol mixture.

According to the first aspect and second aspects of the invention, the compositions necessarily include (d) one or more surfactants which provide a further detersive benefit to the compositions, (but it is to be understood that according to further certain specific particularly embodiments these one or more surfactants are specifically absent).

Useful surfactants which provide a further detersive benefit which may be present in the inventive compositions include detersive surfactants particularly selected from carboxylate surfactants, as well as nonionic, cationic and amphoteric surfactants.

Suitable nonionic surfactants include, inter alia, condensation products of alkylene oxide groups with an organic hydrophobic compound, such as an aliphatic compound or with an alkyl aromatic compound. The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent. Further, the length of the polyethenoxy hydrophobic and hydrophilic elements may be varied to adjust these properties.

One example of such a nonionic surfactant is the condensation product of one mole of an alkyl phenol having an alkyl group containing from 6 to 12 carbon atoms with from about 5 to 25 moles of an alkylene oxide. Another example of such a nonionic surfactant is the condensation product of one mole of an aliphatic alcohol which may be a primary, secondary or tertiary alcohol having from 6 to 18 carbon atoms with from 1 to about 10 moles of alkylene oxide. Preferred alkylene oxides are ethylene oxides or propylene oxides which may be present singly, or may be both present.

Preferred nonionic surfactants include primary and secondary linear and branched alcohol ethoxylates, such as those based on $C_8$ to $C_{14}$ alcohols which further include an average of from 1 to 12 moles of alkoxylation, especially ethoxylation per mol of alcohol Particularly preferred nonionic surfactants are $C_{11}$ linear primary alcohol ethoxylates averaging about 9 moles of ethylene oxide per mole of alcohol. These surfactants are available, for example, under the commercial name of Neodol® 1–9, (from Shell Chemical Company, Houston, Tex.), or in the Genapol® series of linear alcohol ethoxylates, particularly Genapol® 26-L-60 or Genapol® 26-L-80 (from Clariant Corp., Charlotte, N.C.). A further class of nonionic surfactants which are advantageously present in the inventive compositions are those presently marketed under the Genapol® tradename.

Particularly useful are those in the Genapol®) "26-L" series which include for example: :$C_{12}$–$C_{16}$ linear alcohols condensed with 1 mole of ethylene oxide (Genapol® 24-L-3); $C_{12}$–$C_{16}$ linear alcohols condensed with 1.6 moles of ethylene oxide (Genapol® 26-L-1.6); $C_{12}$–$C_{16}$ linear alcohols condensed with 2 moles of ethylene oxide (Genapol® 26-L-2); $C_{12}$–$C_{16}$ linear alcohols condensed with 3 moles of ethylene oxide (Genapol® 26-L-3); $C_{12}$–$C_{16}$ linear alcohols condensed with 3 moles of ethylene oxide (Genapol® 26-L-5); as well as $C_{12}$–$C_{16}$ linear alcohols condensed with varying amounts of ethylene oxide to provide specific cloud points of the surfactant (i.e., Genapol® 26-L-60, Genapol® 26-L-60N, and Genapol® 26-L-98N). These materials are commercially available from Clariant Corp. (Charlotte, N.C.).

A further particularly useful and preferred alcohol ethoxylate is Genapol® UD-079 which is described to be a $C_{11}$ linear alcohol condensed with 7 moles of ethylene oxide to form a nonionic surfactant.

It is to be understood that other nonionic surfactants other than those described: above may also be used. By way of illustration, and not by way of limitation, examples include secondary $C_{12}$ to $C_{15}$ alcohol ethoxylates, including those which have from about 3 to about 10 moles of ethoxylation. Such are available in the Tergitol® series of nonionic surfactants (Union Carbide Corp., Danbury, Conn.), particularly those in the Tergitol® "15-S-" series. Further exemplary nonionic surfactants include linear primary $C_{11}$ to $C_{15}$ alcohol ethoxylates, including those which have from about 3 to about 10 moles of ethoxylation. Such are available in the Neodol® series of nonionic surfactants (Shell Chemical Co.)

A further class of nonionic surfactants which may find use in the present inventive compositions include ethoxylated octyl and nonyl phenols include those having one of the following general structural formulas:

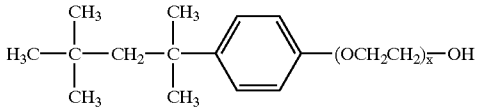

or,

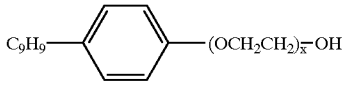

in which the $C_9H_{19}$ group in the latter formula is a mixture of branched chained isomers, and x indicates an average number of ethoxy units in the side chain. Particularly suitable non-ionic ethoxylated octyl and nonyl phenols include those having from about 7 to about 13 ethoxy units. Such compounds are commercially available under the trade name Triton® X (Union Carbide, Danbury Conn.), as well as under the tradename Igepal® (Rhone-Poulenc, Princeton, N.J.). One exemplary and particularly preferred nonylphenol ethoxylate is Igepal® CO-630.

One useful class of surfactants include amine oxide compounds. Exemplary useful amine oxide compounds may be defined as one or more of the following of the four general classes:

(1) Alkyl di (lower alkyl) amine oxides in which the alkyl group has about 6–24, and preferably 8–18 carbon atoms, and can be straight or branched chain, saturated or unsaturated. The lower alkyl groups include between 1 and 7 carbon atoms, but preferably each include 1–3 carbon atoms. Examples include octyl dimethyl amine oxide, lauryl dimethyl amine oxide, myristyl dimethyl amine oxide, and those in which the alkyl group is a mixture of different amine oxides, such as dimethyl cocoamine oxide, dimethyl (hydrogenated tallow) amine oxide, and myristyl/palmityl dimethyl amine oxide;

(2) Alkyl di (hydroxy lower alkyl) amine oxides in which the alkyl group has about 6–22, and preferably 8–18 carbon atoms, and can be straight or branched chain, saturated or unsaturated. Examples include bis-(2-hydroxyethyl) cocoamine oxide, bis-(2-hydroxyethyl) tallowamine oxide; and bis-(2-hydroxyethyl) stearylamine oxide;

(3) Alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and (4) Alkylmorpholine oxides in which the alkyl group has about 10–20, and preferably 12–16 carbon atoms, and can be straight or branched chain, saturated or unsaturated.

While these amine oxides recited above may be used, preferred are amine oxides which may be represented by the following structural representation:

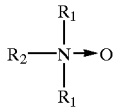

wherein each $R_1$ independently is a straight chained $C_1$–$C_4$ alkyl group, preferably both $R_1$ are methyl groups; and, $R_2$ is a straight chained $C_6$–$C_{22}$ alkyl group, preferably is $C_6$–$C_{16}$ alkyl group, most preferably is a $C_{8-10}$ alkyl group, especially a $C_8$ alkyl group;

Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 75% wt. of $C_8$ alkyl group.

Exemplary and preferred amine oxide compounds include N-alkyl dimethyl amine oxides, particularly octyl dimethyl amine oxides as well as lauryl dimethyl amine oxide. These amine oxide compounds are available as surfactants from McIntyre Group Ltd. under the name Mackamine® C-8 which is described as a 40% by weight active solution of octyl dimethyl amine oxide, as well as from Stepan Co., under the tradename Ammonyx® LO which is described to be as a 30% wt. active solution of lauryl dimethyl amine oxide.

A further class of materials surfactants which may be advantageously included in the inventive compositions are alkoxy block copolymers, and in particular, compounds based on ethoxy/propoxy block copolymers. Polymeric alkylene oxide block copolymers include nonionic surfactants in which the major portion of the molecule is made up of block polymeric $C_2$–$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO—(EO)_x(PO)_y(EO)_z—H \quad (A)$$

where EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use in the new compositions can be represented by the formula (B):

$$R—(EO,PO)_a(EO,PO)_b—H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000–5000.

Still further useful nonionic surfactants containing polymeric butoxy (BO) groups can be represented by formula (C) as follows:

$$RO—(BO)_n(EO)_x—H \quad (C)$$

wherein R is an alkyl group containing 1 to 20 carbon atoms, n is about 5–15 and x is about 5–15.

Also useful as the nonionic block copolymer surfactants, which also include polymeric butoxy groups, are those which may be represented by the following formula (D):

$$HO—(EO)_x(BO)_n(EO)_y—H \quad (D)$$

wherein n is about 5–15, preferably about 15, x is about 5–15, preferably about 15, and y is about 5–15, preferably about 15.

Still further useful nonionic block copolymer surfactants include ethoxylated derivatives of propoxylated ethylene diamine, which may be represented by the following formula:

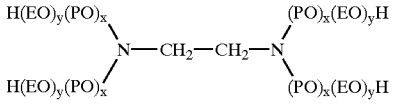

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Of these, the most preferred are those which are represented by formula (A) above; specific examples of which include those materials presently commercially available under the tradename "Pluronic®", and in particular the Pluronic® F series, Pluronic® L series, Pluronic® P series, as well as in the Pluronic® R series, each of which are generally described to be block copolymers of propylene oxide and ethylene oxide. Generally those of the Pluronic® L series and the Pluronic® R series are preferred as these are supplied in liquid form by the manufacturer and are readily formulated into the present inventive compositions. These are also available in a wide range of HLB values, and those having HLB values in the range of 1.0–23.0 may be used, although those with intermediate HLB values such as from about 12.0–18.0 are found to be particularly advantageous. These materials are presently commercially available from BASF AG (Ludwigshafen,. Germany) as well as from BASF Corp. (Mt. Olive Township, N.J.).

A further class of surfactants which may be advantageously included in the inventive compositions are carboxylates, particularly one or more alkylpolyoxycarboxylates including alkyletherpolyoxycarboxylates, or alkylarylpolycarboxylates. Exemplary alkylpolyoxycarboxylates and alkylarylpolycarboxylates include alkyl- and alkylaryl-carboxylates which include those which may be represented by the general formula:

$$R—COO^-M^+$$

wherein R is a straight or branched hydrocarbon chain containing from about 9to 21 carbon atoms, and which may also include an aromatic ring, especially a phenyl group as part of the hydrocarbon chain, and M is a metal or ammonium ion.

Further examples of particularly useful carboxylate surfactants include compounds according to the formula:

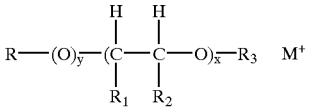

where:

R is a $C_4$–$C_{22}$ linear or branched alkyl group which may optionally include at least one aryl group, preferably $C_8$–$C_{15}$ linear or branched alkyl group which may include at least one aryl group, and yet more preferably a $C_{12}$–$C_{15}$ linear or branched alkyl group which may include at least one aryl group;

x is an integer from 1 to 24, y is 0 or 1, $R_1$, $R_2$ and $R_3$ is a group selected from H, lower alkyl radicals including methyl and ethyl radicals, carboxylate radicals including acetate and propionate radicals, succinate radicals, hydroxysuccinate radicals, or mixtures thereof wherein at least one $R_1$, $R_2$ or $R_3$ is a carboxylate radical; and, $M_+$ is a counterion including an alkali metal counterion (i.e., sodium, potassium) or ammonium counterion.

Free acid forms of the alkylethercarboxylate compounds noted above may also be used.

Examples of such presently available commercial preparations include SURFINE WLG (Finetex Inc., Elmwood Park N.J.), SANDOPAN DTC (Clariant Chem. Co., Charlotte N.C.) in salt forms, and in free acid forms include those marketed under the tradename NEODOX (Shell Chemical Co., Houston Tex.). One particularly preferred carboxylate is one which is represented by the formula:

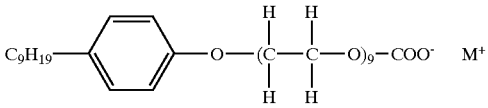

Such a material is presently commercially available under the tradename Emcol®, and specifically as Emcol® CNP-110.

Other useful exemplary nonionic block copolymers based on a polymeric ethoxy/propoxy units which may also be used include those presently commercially available in the Poly-Tergent® E, and Poly-Tergent® P series of materials from Olin Chemicals Corp., (Stamford Conn.). These are described to be nonionic surfactants based on ethoxy/propoxy block copolymers, conveniently available in a liquid form from its supplier.

It is to be understood that these nonionic surfactants based on polymeric alkylene oxide block copolymers may be used singly or in mixtures of two or more such compounds.

When the compositions of the present invention contain one or more further detersive surfactants, these may be present in any amount which is found to provide a beneficial detersive effect. Generally, these one or more further detersive surfactants do not comprise more than 12% wt. (on an actives weight basis) of the inventive compositions. When included such one or more further detersive surfactants are advantageously present in an amount from 0.001–10% wt., preferably are present from 0.01–8% wt., but still more preferably are included in amounts of from 0.1–8% wt.

According to the first aspect and third aspects of the invention, the compositions necessarily include (e) one or more organic solvents, (but it is to be understood that according to further certain specific particularly embodiments these one or more surfactants are specifically absent.)

Exemplary organic solvents which may be included in the inventive compositions include those which are at least partially water-miscible such as alcohols, water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, propylene glycol monohexyl ether, ethylene glycol monobutylether, dipropylene glycol monomethylether, dipropylene glycol monobutylether, diethyleneglycol monobutylether), lower esters of monoalkylethers of ethyleneglycol or propylene glycol (e.g. propylene glycol monomethyl ether acetate) all commercially available such as from Union Carbide (Danbury, Conn.), Dow Chemical Co. (Midland, Mich.) or Hoescht (Germany). Mixtures of several organic solvents can also be used.

Preferred as solvents in this invention are the glycol ethers having the general structure. $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Preferred are glycol ethers having one to five glycol monomer units. These are $C_3$–$C_{20}$ glycol ethers. Examples of more preferred solvents include propylene glycol methyl ether, dipropylene glycol methyl ether, dipropylene glycol monobutyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Particularly preferred solvents include those demonstrated by the examples.

The compositions are largely aqueous in nature, and comprise as a further necessary constituent (f) water. Water is added to order to provide to 100% by weight of the compositions of the invention. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention.

As discussed previously, the inventive compositions may comprise one or more conventional optional additives. By way of non-limiting example, these include: pH adjusting agents and pH buffers including organic and inorganic salts (e.g., sodium carbonate); non-aqueous solvents, fragrances, optical brighteners, coloring agents such as dyes and pigments, opacifying agents, hydrotropes, antifoaming agents, viscosity modifying agents such as thickeners, antioxidants, anti-corrosion agents as well as others not specifically elucidated here. These optional additives may be present in any combinations and in any suitable amount that is sufficient for imparting the desired properties to the compositions. These one or more conventional additives, when present, should be present in minor amounts, preferably in total comprise less than about 5% by weight (on an active weight basis) of the compositions, and desirably less than about 3% wt.

Such materials described above are known to the art, including those described in *McCutcheon's Emulsifiers and Detergents* (*Vol.* 1), *McCutcheon's Functional Materials* (*Vol.* 2), North American Edition, 1998; *Kirk-Othmer, Encyclopedia of Chemical Technology*, 4th Ed., Vol. 23, the contents of which are herein incorporated by reference. For any particular composition, any optional constituents should be compatible with the other ingredients present.

The aqueous compositions according to the invention are desirably provided as a ready to use product which may be directly applied to a hard surface. Hard surfaces which are to be particularly denoted are lavatory fixtures, lavatory appliances (toilets,. bidets, shower stalls, bathtubs and bathing appliances), wall and flooring surfaces especially those which include refractory materials and the like. Further hard surfaces which are particularly denoted are those associated with kitchen environments and other environments associated with food preparation. Hard surfaces which are those associated with hospital environments, medical laboratories and medical treatment environments. Such hard surfaces described above are to be understood as being recited by way of illustration and not be way of limitation.

The composition provided according to the invention can be desirably provided as a ready to use product in a manually operated spray dispensing container, or may be supplied in an aerosolized product wherein it is discharged from a pressurized aerosol container. Known art propellants such as liquid propellants based on chloroflurocarbons or propellants of the non-liquid form, i.e., pressurized gases, including carbon dioxide, air, nitrogen, as well as others, may be used, even though it is realized that the former chlorofluorocarbons are not generally further used due to environmental considerations.

The composition according to the invention is ideally suited for use in a consumer "spray and wipe" application. In such an application, the consumer generally applies an effective amount of the cleaning composition using the pump and within a few moments thereafter, wipes off the treated area with a rag, towel, or sponge, usually a disposable paper towel or sponge. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used. It is also to be understood that longer residence time of the inventive compositions on a hard surface may be required in order to attain greater degrees of disinfection. Where thorough disinfection is a primary consideration, it may be desired to apply the inventive compositions to the hard surface being treated and to permit the composition to remain on the hard surface for several minutes (2–10 min.) prior to rinsing or wiping the composition from the hard surface. It is also contemplated that the inventive compositions be applied to a hard surface without subsequently wiping or rinsing the treated hard surface.

In a yet a further embodiment, the product according to the invention may be formulated so that it may be useful in conjunction with a "aerosol" type product wherein it is discharged from a pressurized aerosol container. Known art propellants such as liquid propellants based on chlorofluorocarbons or propellants of the non-liquid form, i.e., pressurized gases, including carbon dioxide, air, nitrogen, as well as others, may be used, even though it is realized that the former chlorofluorocarbons are not generally further used due to environmental considerations. In such an application, the cleaning composition is dispensed by activating the release nozzle of said aerosol type container onto the stain and/or stain area, and in accordance with a manner as above-described a stain is treated and removed.

Whereas the compositions of the present invention are intended to be used in the types of liquid forms described, nothing in this specification shall be understood as to limit the use of the composition according to the invention with a further amount of water to form a cleaning solution therefrom. In such a proposed diluted cleaning solution, the greater the proportion of water added to form said cleaning dilution will, the greater may be the reduction of the rate and/or efficacy of the thus formed cleaning solution.

Accordingly, longer residence times upon the stain to effect their loosening and/or the usage of greater amounts may be necessitated. Conversely, nothing in the specification shall be also understood to limit the forming of a "super-concentrated" cleaning composition based upon the composition described above. Such a super-concentrated ingredient composition is essentially the same as the cleaning compositions described above except in that they include a lesser amount of water.

The composition of the present invention, whether as described herein or in a. concentrate or super-concentrate form can also be applied to a hard surface by using a wet wipe. The wipe can be of a woven or non-woven nature. Fabric substrates can be used to form the wipe. Exemplary fabric substrates can include non-woven and woven pouches, sponges, in the form of abrasive or non-abrasive cleaning pads. Such fabrics are known commercially in this field and are often referred to as wipes. Such substrates can be resin bonded, hydroentangled, thermally bonded, meltblown, needlepunched or any combination of the former.

The non-woven fabrics may be a combination of wood pulp fibers and textile length synthetic fibers formed by well known dry-form or wet-lay processes. Synthetic fibers such as Rayon, Nylon, Orlon and Polyester as well as blends thereof can be employed.

The wood pulp fibers should comprise about 30 to about 60 percent by weight of the non-woven fabric, preferably about 55 to about 60 percent by weight, the remainder being synthetic fibers. The wood pulp fibers provide for absorbency, abrasion and soil retention whereas the synthetic fibers provide for substrate strength and resiliency.

The substrate of the wipe may also be a film forming material such as a water soluble polymer. Such substrates include self-supporting film substrates including those which may be sandwiched between layers of fabric substrates and head sealed to form a useful substrate. The free standing films can be extruded utilizing standard equipment to devolatilize the blend. Casting technology can also be used to form and dry films or a liquid blend can be saturated into a carrier and then dried via any of a variety of known methods.

The compositions of the present invention are absorbed onto the wipe to form a saturated wipe. The wipe can then be sealed in individually into a pouch which can then be opened when needed or a multitude of wipes can be placed in a container for use on, an as needed basis. The container, when closed, sufficiently seals to prevent evaporation of any components from the compositions.

The following examples below illustrate exemplary and preferred formulations of the concentrate composition according to the instant invention. It is to be understood that these examples are presented by means of illustration only and that further useful formulations fall within the scope of this invention and the claims may be readily produced by one skilled in the art and not deviate from the scope and spirit of the invention.

Throughout this specification and in the accompanying claims, weight percents of any constituent are to be understood as the weight percent of the active portion of the referenced constituent, unless otherwise indicated.

EXAMPLES

The following examples illustrate the formulation and performance of various compositions of the invention, as well as certain particularly preferred embodiments of the invention.

Exemplary formulations illustrating certain preferred embodiments of the inventive compositions and described in more detail in Table 1 below were formulated generally in accordance with the following protocol. The weight percentages indicated the "as supplied" weights of the named constituent.

Into a suitably sized vessel, a measured amount of water was provided after which the constituents were added in no specific or uniform sequence, which indicated that the order of addition of the constituents was not critical. All of the constituents were supplied at room temperature, and any remaining amount of water was added thereafter. Certain of the nonionic surfactants if gels at room temperature were first preheated to render them pourable liquids prior to addition and mixing. Mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well mixed characteristics (i.e., stable mixtures) upon standing for extend periods. The compositions of the example formulations are listed on Table 1.

TABLE 1

| | Ex. 1 (% w/w) | Ex. 2 (% w/w) | Ex. 3 (% w/w) | Ex. 4 (% w/w) | Ex. 5 (% w/w) | Ex. 6 (% w/w) | Ex. 7 (% w/w) | Ex. 8 (% w/w) | Ex. 9 (% w/w) |
|---|---|---|---|---|---|---|---|---|---|
| BTC 8358 | 0.05625 | 0.05625 | 0.05625 | 0.05625 | 0.05625 | 0.05625 | 0.027 | 0.027 | 0.027 |
| BTC 65NF | — | — | — | — | — | — | 0.172 | 0.172 | 0.172 |
| Fluorad FC-171 | 0.01 | 0.01 | 0.01 | — | — | — | 0.1 | 0.1 | — |
| Fluorad FC-135 | — | — | — | 0.02 | — | — | — | — | — |
| Zonyl FSN 100 | — | — | — | — | 0.01 | — | — | — | — |
| Genapol 26-L-80 | — | — | — | — | — | — | 0.5 | 0.5 | 0.5 |
| Ammonyx CDO Special | — | — | — | — | — | — | 0.5 | 0.5 | 0.5 |
| Dowanol DPnB | — | — | — | — | — | — | 2.1 | 2.1 | 2.1 |
| $Na_2CO_3$ (anhydrous) | — | — | — | — | — | — | 0.084 | 0.084 | 0.084 |
| Zonyl FSO 100 | — | — | — | — | — | 0.01 | — | — | — |
| AEM 5700 | 0.125 | 0.25 | 0.375 | 0.25 | 0.25 | 0.25 | — | — | — |
| DI water | qs | qs | qs | qs | qs | qs | qs | qs | qs |

As is indicated, to all of the formulations of Table 1 was added sufficient deionized water in"quantum sufficient" "qs") to provide 100 parts by weight of a particular formulation.

The identity of the constituents of used to produce various formulations described herein are disclosed on Table 2, below, including the "actives" percentage of each were a constituent was not 100% wt. "actives".

TABLE 2

| | |
|---|---|
| BTC-8358 | alkyl dimethyl benzyl ammonium chloride (80% actives) from Stepan Company |
| BTC-65NF | alkyl dimethyl benzyl ammonium chloride (50% actives) from Stepan Company |
| Fluorad FC-171 | fluorinated alkyl alkoxylate (100% active) from 3M |
| Fluorad FC-135 | fluorinated alkyl quaternary ammonium iodides (50% active) 3M |
| Zonyl FSN 100 | ethoxylated fluorinated nonionic surfactant (100% active) from DuPont |
| Zonyl FSO 100 | ethoxylated fluorinated nonionic surfactant (100% active) from DuPont |
| Genapol 26-L-80 | linear $C_{12}$–$C_{16}$ alcohol ethoxylate, avg. 9 moles of EO (100% active) from Clariant |
| Ammonyx CDO Special | cocoamidopropylamine oxide (30% active) from Stepan Co. |
| Dowanol DPnB | dipropylene glycol n-butyl ether (100% active) from Dow Chemical |
| $Na_2CO_3$ anhydrous | sodium carbonate (99% pure) from FMC |
| AEM 5700 | 3-(trimethoxysilyl)propyloctadecyldimethyl ammonium chloride ( 40% active) from Aegis Environmentals |
| DI Water | deionized water |

Certain of the compositions described on Table 1 were subjected to one or more of the following evaluations.

Cleaning Efficacy

Certain of the compositions indicated above were diluted with water at a respective weight ratio of composition:water of 1:64. These diluted compositions were then subjected to the protocol of ASTM D-4488–89 Annex A5 for particulate soil, which evaluated the efficacy of the cleaning compositions on vinyl tile samples. The soil applied was a particulate soil sample containing natural humus, paraffin oil, used crankcase motor oil, Portland cement, silica, lampblack carbon, iron oxide, bandy black clay, stearic acid, and oleic acid. produced according to the protocol. Each of the soiled test vinyl tile samples were placed into the apparatus and the center of each tile was wetted with a 20 milliliter sample of a test formulation and allowed to stand for 1 minute. When approximately 30 seconds had elapsed, a further 50 milliliter sample was applied to the sponge (water dampened, then wrung to remove excess water) of a Gardner Abrasion Tester apparatus. Thereafter the apparatus was cycled 10 times, which provided 20 strokes of the sponge across the face of each of the vinyl test tiles. Each test was replicated three times using three vinyl tile samples. The reflectance values of the cleaned samples were evaluated utilizing a Minolta Chroma Meter CF-110, with Data Processor DP-100, which evaluated spectrophotomic characteristics of the sample. The averaged results of the three readings are reported on Table 3, following. These results were compared to a commercially available product, Lysol® Disinfectant Cleaner Country Scent (Reckitt & Colman Inc., Montvale, N.J.) which was tested in the same manner as the formulations according to the invention.

TABLE 3

| | percentage reflectance (%) |
|---|---|
| Lysol ® Disinfectant Cleaner Country Scent | 54.1 |
| Ex. 3 | 58.3 |

With respect to the results reported on Table 3 a value of "100" is indicative of a white (unsoiled) background, and a "0" value is indicative of a black background. As can be seen from the results of Table 3, the cleaning efficacy of the composition according to the invention generally provided superior results or were on parity with those of known art cleaning products.

Antimicrobial Efficacy

Ex. 1, 2, and 3, together with the comparatives set forth below in Table 4, were also evaluated for antimicrobial activity using the Biomek® 2000 Laboratory Automation Workstation together with the BioWorks Operating System (available from Beckman Coulter Inc., Fullerton, Calif.). The organism tested was *Staphylococcus aureus* at a concentration of 9 logs. The Biomek simulates a microbial reduction suspension test and is generally run as follows:

TABLE 4

| | Comparative 1 | Comparative 2 | Comparative 3 | Comparative 4 |
|---|---|---|---|---|
| BTC 8358 | 0.05625 | 0.05625 | 0.05625 | 0.05625 |
| Fluorad FC-171 | 0.01 | — | — | — |
| AEM 5700 | — | 0.125 | 0.25 | 0.375 |
| DI water | q.s. | q.s. | q.s. | q.s. |

For each example or comparative tested, one part of organism suspension (*Staphylococcus aureus*) is added to 9 parts of the Example or Comparative in an appropriate container. Deionized water (DI $H_2O$) was used as a control. The organism and sample are then mixed thoroughly for 15. seconds. Serial tenfold dilutions are carried out in a neutralizing broth. The diluted samples are then incubated for 24–48 hours at 35–37° C. Thereafter, surviving organisms are quantified and log reduction, as a measurement of organism survivors are calculated as follows:

Log Reduction=(Log Survivors/DI $H_2O$ Control)−(Log Survivors/Sample)

The results of the antimicrobial testing are set forth in Table 5. The DI water recovery control was 8.62 and the quaternary ammonium compound used in the testing recovery control was 7.5. The data represent the average of two runs per sample.

TABLE 5

| | Log Reduction |
|---|---|
| Ex. 1 | 2.86 |
| Ex. 2 | 1.50 |
| Ex. 3 | 1.51 |
| Comparative 1 | 2.10 |
| Comparative 2 | 2.29 |
| Comparative 3 | 2.11 |
| Comparative 4 | 1.61 |

As may be seen from the results indicated above, the compositions according to the invention provide excellent cleaning benefits to hard surfaces, including hard surfaces with difficult to remove stains notwithstanding the low solids content of the inventive compositions. These advantages are further supplemented by the excellent antimicrobial efficacy of these compositions against known bacteria commonly found in bathroom, kitchen and other. Such advantages clearly illustrate the superior characteristics of the compositions, the cleaning and antimicrobial benefits attending its use which is not before known to the art.

Surface Protection

The surface repellency of treated tiles was evaluated by determining the contact angle of water on treated tile. The contact angle was determined for a particular formulation by spraying a quantity onto a 22 mm by 22 mm micro cover glass plate and thereafter allowing the formulation to dry on the glass plate. Thereafter the treated plate was provided to a Kruss® Tensiometer (Model K12) which automatically evaluated the advancing contact angle according to the Wilhelmy equation:

$$\cos A = F/(L \cdot S)$$

wherein: A=contact angle

L=wetted length

F=measured force

S=surface tension of the test liquid (deionized water).

The advancing contact angle was measured for a sample according to the Examples as described on Table 1, above, as well as for a control sample, an untreated 22 mm by 22 mm micro cover glass plate. The samples were automatically evaluated by the Kruss® Tensiometer a plurality of times, and the average of these plural readings is reported on the following Table 6.

TABLE 6

| | Advancing contact angles, in degrees (°) | |
|---|---|---|
| Sample # | Ex. 3 | Comparative |
| 1 | 82.9° | 52.8° |
| 2 | 84.6° | 54.4° |
| 3 | 82.6° | 53.5° |
| 4 | 85.0° | 56.7° |
| 5 | 80.5° | 53.8° |
| 6 | 79.1° | — |
| Average value | 82.5° | 54.2° |

Advancing contact angles for Ex. 1 and Ex. 2 were also determined and there data also indicate the presence of a film on a glass plate (avg. 81.6° and 86.7°).

The advancing contact angles for Ex. 3 indicate the presence of a hydrophobic film on the surface of the micro cover glass plate.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents, and alternatives falling within the scope and spirit of the invention as expressed in the appended claims.

What is claimed is:

1. A hard surface cleaning and disinfecting composition which comprises:

(a) at least one cationic surfactant having germicidal properties;

(b) a fluorosurfactant according to the structure $$C_nF_{2n+1}SO_2NHC_3H_6N^+(CH_3)_3I^-$$

where n~8; and (c) a film forming, organosilicone quaternary ammonium compound;

(d) optionally, one or more detersive surfactants;

(e) optionally, one or more organic solvents;

(f) water; and (g) optionally, one or more further conventional optional constituents selected from the group consisting of: pH buffering agents, perfumes, perfume carriers, colorants, hydrotropes, viscosity modifying agents, further germicides, fungicides, anti-oxidants, and anti-corrosion agents.

2. The hard surface cleaning and disinfecting compositions according to claim 1 which is characterized as containing (d) one or more detersive surfactants selected from carboxylate surfactants, nonionic surfactants, cationic surfactants, amphoteric surfactants, and mixtures thereof and (e) one or more organic solvents.

3. The hard surface cleaning and disinfecting compositions according to claim 1 which is characterized in that (d) one or more detersive surfactants are not included.

4. The hard surface cleaning and disinfecting compositions according to claim 1 which is characterized in (e) one or more organic solvents are not included.

5. The hard surface cleaning and disinfecting compositions according to claim 1 which is characterized in (d) one or more detersive and (e) one or more organic solvents are not included.

* * * * *